US006776877B2

(12) United States Patent
Grabsoheid et al.

(10) Patent No.: US 6,776,877 B2
(45) Date of Patent: Aug. 17, 2004

(54) TWIN WIRE FORMER FOR THE PRODUCTION OF A FIBER WEB FROM A FIBER SUSPENSION

(75) Inventors: Joachim Grabsoheid, Gerstetten (DE); Volker Schmidt-Rohr, Heidenheim (DE); Johann Moser, Heidenheim (DE)

(73) Assignee: Voith Paper Patent GmbH, Heidenheim (DE)

( * ) Notice: Subject to any disclaimer, the term of this patent is extended or adjusted under 35 U.S.C. 154(b) by 0 days.

(21) Appl. No.: 10/074,551

(22) Filed: Feb. 13, 2002

(65) Prior Publication Data

US 2002/0108732 A1 Aug. 15, 2002

(30) Foreign Application Priority Data

Feb. 14, 2001 (DE) ..... 101 06 731

(51) Int. Cl.[7] ..... D21F 9/00; D21F 3/10

(52) U.S. Cl. ..... 162/301; 162/300; 162/352; 162/368

(58) Field of Search ..... 162/203, 300, 162/301, 352, 298, 299, 208, 211, 217, 132, 133, 290, 304, 351

(56) References Cited

U.S. PATENT DOCUMENTS

| | | | | | |
|---|---|---|---|---|---|
| 4,141,788 | A | * | 2/1979 | Justus | 162/301 |
| 4,209,360 | A | | 6/1980 | Stenberg et al. | 162/203 |
| 4,619,737 | A | | 10/1986 | Holz | 162/357 |
| 5,078,835 | A | | 1/1992 | Schiel et al. | 162/352 |
| 5,129,988 | A | * | 7/1992 | Farrington, Jr. | 162/301 |
| 5,225,043 | A | | 7/1993 | Braun et al. | 162/301 |
| 5,259,929 | A | * | 11/1993 | Bubik et al. | 162/301 |
| 5,282,933 | A | * | 2/1994 | Bubik et al. | 162/301 |
| 5,300,196 | A | * | 4/1994 | Kraft | 162/300 |
| 5,389,206 | A | * | 2/1995 | Buck et al. | 162/301 |
| 5,759,353 | A | * | 6/1998 | Jaakkola et al. | 162/301 |
| 5,798,024 | A | * | 8/1998 | Odell et al. | 162/301 |
| 5,914,009 | A | * | 6/1999 | Kotitschke | 162/301 |

FOREIGN PATENT DOCUMENTS

| | | | |
|---|---|---|---|
| EP | 0 504 123 | 3/1992 | D21F/9/00 |
| EP | 0 627 523 | 5/1994 | D21F/9/00 |
| EP | 0 627 523 A1 | 12/1994 | D21F/9/00 |
| EP | 0 699 798 A1 | 3/1996 | D21F/9/00 |
| WO | WO 97/47803 | 12/1997 | D21F/1/00 |

OTHER PUBLICATIONS

K. Müller, A. Bubik and T. Schaible, "Gap Forming Technology with TWIN–Former G for Testliner and Corrugating Medium", Jul., 1991.

* cited by examiner

*Primary Examiner*—Steven P. Griffin
*Assistant Examiner*—Eric Hug
(74) *Attorney, Agent, or Firm*—Taylor & Aust, P.C.

(57) ABSTRACT

The invention relates to a twin wire former for the production of a fiber web specifically a paper, cardboard or tissue web, from a fiber suspension. The invention is characterized in that the rotating forming roll has an open volume and is a non-suction type;

the rotating forming roll has a forming roll diameter of less than 1,400 mm;

the rotating forming roll has a forming roll angle of wrap of less than 70°;

a forming suction box is located immediately downstream from the rotating forming roll as viewed in direction of wire travel; and in the area of the wedge-shaped inlet nip, the fiber stock suspension has a stock density of between 0.4% and 2.0%, preferably between 0.6% and 1.5%.

These characteristics result in an improved forming quality and web quality.

24 Claims, 3 Drawing Sheets

TWIN WIRE FORMER FOR THE PRODUCTION OF A FIBER WEB FROM A FIBER SUSPENSION

BACKGROUND OF THE INVENTION

1. Field of the Invention

The present invention relates to a twin wire former for the production of a fiber web, specifically a paper, cardboard or tissue web, from a fiber suspension. This type of twin wire former is generally referred to as "Roll-Blade-Former" in the industry.

2. Description of the Related Art

A twin wire former of this type for the production of a paper web, specifically a fine paper web, is already known from the PCT-disclosure document WO 97/47803. The disclosed twin wire former includes an upstream headbox with several separation elements in its headbox nozzle, and a forming roll, preferably a suction type forming roll, having a roll diameter of ≧1.4 m and an angle of wrap of <25°. In a curved twin wire zone located downstream from the forming roll, there are also methods for the introduction of pulsating pressure effects into the paper web that is being formed.

Further, a twin wire former as mentioned above, for the production of a paper web, specifically SC paper, is also known from the European patent application EP 0 627 523 A1. Here, initial dewatering of a fiber suspension occurs on a first forming roll in a forming zone. The fiber suspension is then brought onto a curved forming shoe, having a radius of 2 m to 8 m and is further dewatered. Subsequently, at least one dewatering unit including dewatering methods is located in the line. At the end zone of the twin wire zone there is a second forming roll including at least one suction zone, where the top wire of the twin wire former is separated from the forming paper web and is led away by way of a guide roll.

The two aforementioned twin wire formers have in common that the dewatering accomplished on the forming roll or in the area of the forming zone is greater than 70%. Since considerable portions of the paper web are formed without the presence of pressure pulsations, a forming quality that is only average is unavoidable when running fiber stock suspensions that are difficult to form. It is also a disadvantage that both twin wire formers have a very long open jet distance (distance: headbox nozzle to jet impact point), for example longer than 400 mm. This has a negative effect on the web quality, in machine direction (MD) as well as in machine cross direction (CD).

In order to achieve optimum sheet quality, a certain level of forming strip dewatering is particularly important. This requires very precise dimensioning of the forming angle, since large volumes are dewatered per angle degree. The optimum forming roll wrap must generally be determined during pilot trials, which are expensive and time intensive. Since the angle of wrap must always be matched to paper type, web weight and machine speed, even a small change in any one parameter causes extensive effects, which then will have to be neutralized at great expense.

If the sheet formation system is required to accommodate a larger weight range (specific production volume P), which is always the case with production lines, then the operating point abandons the optimum operating range on product changes. In the instance of the aforementioned twin wire formers, the fiber stock suspension throughput through the headbox must then be increased detrimentally in order to regain the optimum operating window.

The present invention provides an improved twin wire former to such an extent that the aforementioned disadvantages of the state of the art are avoided. A second objective is that fiber stock suspensions having a high long fiber content which makes them particularly difficult to form, for example papers, may find optimum use.

SUMMARY OF THE INVENTION

Characteristics of the present invention include:

- the rotating forming roll has an open volume (storage volume) and is a non-suction type,
- the rotating forming roll has a roll diameter of less than 1,400 mm,
- the rotating forming roll has an angle of wrap of less than 7°,
- a forming suction box is located immediately downstream from the rotating forming roll as viewed in the direction of wire travel, and
- in the area of the wedge-shaped inlet nip, the fiber suspension has a stock consistency of between 0.4% and 2.0%, preferably between 0.6% and 1.5%.

By combining these characteristics in a twin wire former, the initial dewatering (dwell time) on the forming roll, or the dewatering volume is reduced to a minimum, whereby the minimum is smaller than 30% relative to the headbox throughput of a fiber stock suspension having a stock density of between 0.4% and 2.0%, preferably between 0.6% and 1.5% in the area of the wedge-shaped inlet nip. This is achieved by the maximum forming roll diameter of 1,400 mm and by the maximum forming roll angle of wrap of 7°. The maximum forming roll diameter of 1,400 mm and the maximum forming angle of wrap of 70 cause a greatly reduced dwell time on the forming roll.

Moreover, the minimum initial dewatering on the forming roll ensures a non-critical positioning of the headbox jet.

The headbox in whose nozzle—at least one machine-wide separation element, specifically a plate—is located produces a high quality headbox jet. In accordance with the present invention, this allows and even favors utilization in the twin wire former, of fiber stock suspensions having a high long fiber content (for example paper) which are particularly difficult to form.

The surface of the forming roll having the "open volume" is grooved and/or drilled and/or deflected, or is constructed in a honeycomb design. These configurations are cost effective to produce and do not influence the rigidity or the operational safety of the forming roll negatively, which, depending upon the application may be up to 10 m wide.

In order to considerably increase the dewatering capacity of the twin wire former of the present invention, at least one additional forming suction box must be located following the forming suction box as viewed in direction of wire travel.

In order to achieve as symmetrical a web quality as possible, the forming suction boxes are located opposite each other, whereby the forming suction boxes, as viewed in the direction of wire travel, may have some distance between them.

Under technological and qualitative aspects it is advantageous if the at least one forming suction box has a curved suction surface having a radius of curvature of 1,500 mm to 10,000 mm, preferably of 2,000 mm to 5,000 mm.

At least one forming suction box includes at least one suction chamber, whose vacuum is adjustable/controllable by way of a controllable vacuum source. This permits, and even enhances considerably the adjustment of optimum operating conditions in the area of the forming suction box.

In order to once more increase the dewatering capacity of the twin wire former in accordance with the present invention, while maintaining good web qualities, a multitude of forming strips are located opposite at least one forming suction box. In accordance with the present invention at least one of the forming strips is mounted flexibly and/or at least one of the forming strips is mounted stationary, whereby their base position is adjustable relative to their wire, for example by way of sliding or pivoting.

Additionally, at least one wet suction box is located downstream from at least one forming suction box as viewed in the direction of wire travel. Preferably, the wet suction box is supplied with vacuum, whereby the vacuum is adjustable/controllable by way of a controllable vacuum source. This permits, and even considerably enhances, the adjustment of optimum operating conditions in the area of the wet suction box.

In order to keep the spatial dimensions of the twin wire former according to the present invention as small as possible, a turning roller is located prior to the separation element as viewed in the direction of wire travel, thereby reducing the actual horizontal and/or vertical length of the twin wire zone to a certain degree.

In order to permit further processing of the fiber web that is supported on the wire after the separation from the top and bottom wires, at least one flat suction box and a suction couch roll are located after the separating element as viewed in the direction of travel of the wire. This allows the degree of dewatering of the fiber web to be increased further.

When using wood-free fiber suspensions it is also advantageous if at least one machine-wide separating element, specifically a plate, is located in the nozzle of the headbox.

In a first embodiment, the twin wire zone of the twin wire former according to the present invention can essentially rise vertically from the bottom to the top, preferably with a vertical excursion of −15° to +15°, preferably from −5° to +5°; and in a second configuration can rise from the bottom to the top with an incline from the horizontal plane of approximately 5° to 45°. In another embodiment, the twin wire zone can slope from the top to the bottom with sloping gradient in the end zone. These embodiments represent the known possibilities in accordance with the state of the art, and have proven themselves frequently in the field.

It is understood that the aforementioned characteristics of the invention, which will be explained in further detail below, may be utilized not only in the cited combinations but also in other combinations, or freestanding, without abandoning the scope of the invention.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
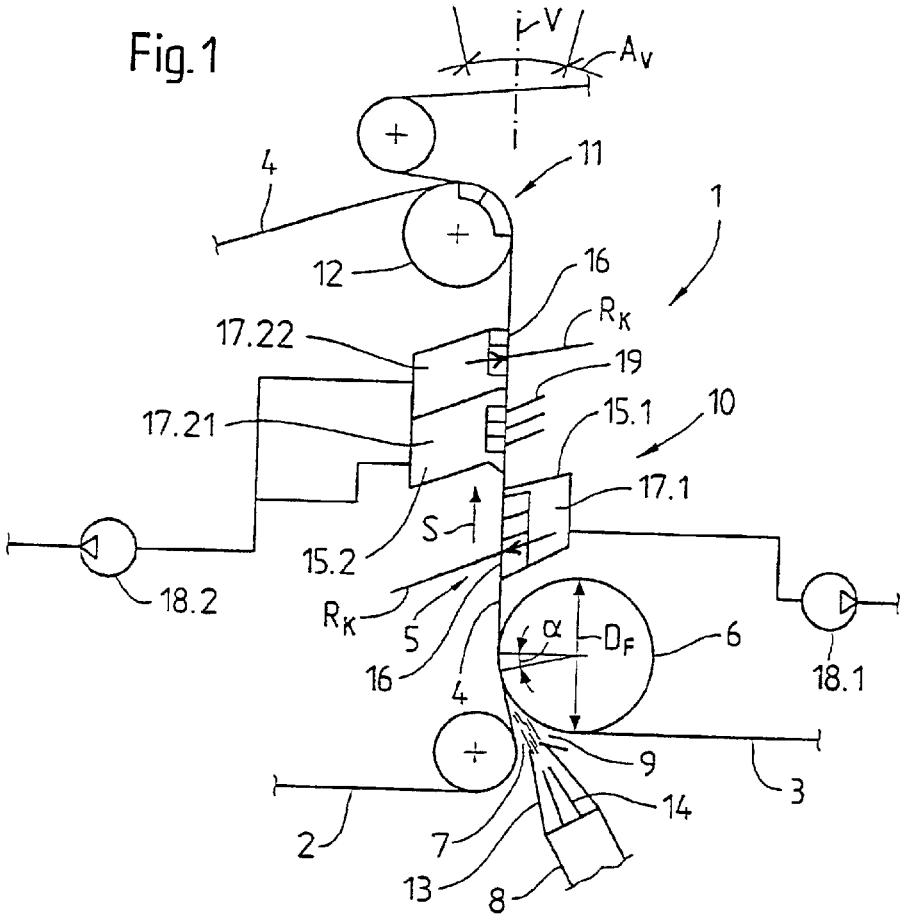
FIG. 1 is a schematic side view representation of a first embodiment of the twin wire former of the present invention.

Referring now to the drawings, and more particularly to FIG. 1, there is shown a first embodiment of the twin wire former 1 in accordance with the present invention. Two continuous wires (bottom wire 2 and top wire 3) together form a twin wire zone 5. In an initial area of the twin wire zone 5 in which the two wires 2, 3 run over a dewatering element which is in the embodiment of a rotating forming roll 6, the two wires 2, 3 together form a wedge-shaped inlet nip 7 ("Gap-Former") at the forming roll 6. The nip directly accepts the fiber suspension 9 from a headbox 8 which is located at an angle toward the left and top and which is illustrated only in part. In a central area of the twin wire zone 5 the two wires 2, 3 together with the fiber web 4 which is forming between them, run over a multitude of additional dewatering and forming elements 10. In an end area of the twin wire zone 5, viewed in direction of wire travel S (arrow), the two wires 2, 3 run over a separating element 11 which is in the embodiment of a suction couch roll 12, which separates the top wire 3 from the formed fiber web 4 and from the bottom wire 2.

According to the present invention rotating forming roll 6 has an open volume (storage volume) and has no suction. The rotating forming roll 6 according to the present invention also has a diameter DF smaller than 1,400 mm and a forming angle of wrap a smaller than 7°. Moreover, provisions are made in accordance with the present invention that a forming suction box 15.1 is located immediately following the rotating forming roll 6, viewed in the direction of wire travel S, preferably on the same side as the forming roll. In the area of the inlet nip 7 the fiber suspension 9 has a stock consistency according to the present invention of between 0.4% and 2.0%, preferably between 0.6% and 1.5%.

The open volume of the forming roll 6 is such that its surface is grooved and/or drilled and/or deflected or is constructed in a honeycomb design. An additional forming suction box 15.2 is also located downstream from the first forming suction box 15.1, as viewed in the direction of wire travel S, whereby the forming suction boxes 15.1 and 15.2 are located opposite each other and at a distance from each other. The forming suction boxes 15.1, 15.2 have a curved suction surface 16 having a radius of curvature $R_K$ (arrow) of 1,500 mm to 10,000 mm, specifically of 2,000 mm to 5,000 mm.

The first forming suction box 15.1 includes at least one suction chamber 17.1, the second forming suction box 15.2 includes two suction chambers 17.21, 17.22 whose vacuums are adjustable/controllable by means of controllable vacuum sources 18.1, 18.2.

In accordance with the present invention a multitude of forming strips 19 are located opposite the first suction chamber 17.21 of the second forming suction box 15.2. At least one of the forming strips 19 is mounted flexibly, or at least one of the forming strips 19 is mounted stationary, whereby their base positions are adjustable relative to the top wire 3, for example by means of sliding or pivoting.

Additionally, the headbox 8 includes a headbox nozzle 13 in which at least one machine-wide separating element 14, specifically a plate, is located. Two separating elements 14 are depicted in FIG. 1. This separating element 14 may be divided into sections across the machine width and its effective length may be designed to be movable within the headbox nozzle 13 by way of a mechanism including a control unit. Utilization of at least one separating element 14 is recommended, particularly when using wood-free fiber suspensions.

The twin wire zone 5 of the twin wire former 1 covered by the present invention, as viewed in the direction of wire travel S, essentially rises vertically from the bottom to the top, whereby the vertical excursion Av from the vertical plane V assumes a value of −15° to +15°, preferably from −5° to +5°.

Figure 2:
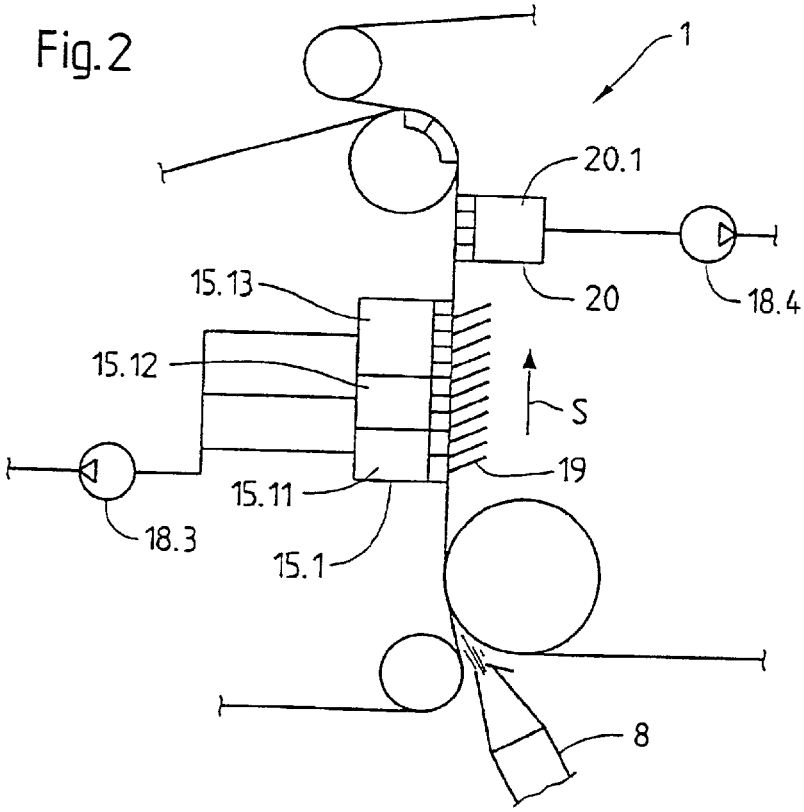
FIG. 2 is a schematic side view representation of a second embodiment of the twin wire former of the present invention.

A schematic side view of a second embodiment, which is similar to the first embodiment of the twin wire former 1, according to the present invention, is shown in FIG. 2. We hereby refer to FIG. 1 for reference.

The present invention provides that a wet suction box 20 which is effective on the top wire 3 is located downstream from the first forming suction box 15.1 which is effective on the bottom wire 2 as viewed in the direction of wire travel S. The forming suction box 15.1 includes three suction chambers 15.11, 15.12 15.13, whereby the vacuum is controlled by way of an adjustable vacuum source 18.3. In contrast, the wet suction box 20 includes only one suction chamber 20.1 which is supplied with vacuum, whereby the vacuum is controlled by way of an adjustable vacuum source 18.4. A multitude of forming strips 19 are located opposite the forming suction box's 15.1 three suction chambers 15.11, 15.12, and 15.13. The headbox 8, which is illustrated only partially in FIG. 2, does not contain a machine wide separation element, specifically a plate.

Figure 3:
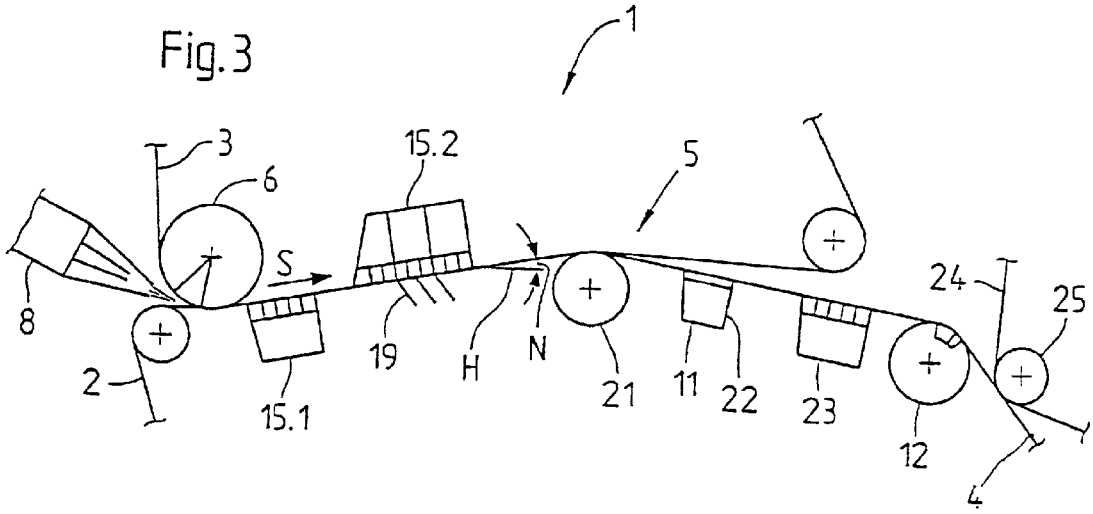
FIG. 3 is a schematic side view of a third embodiment of the twin wire former of the present invention.
Figure 4:
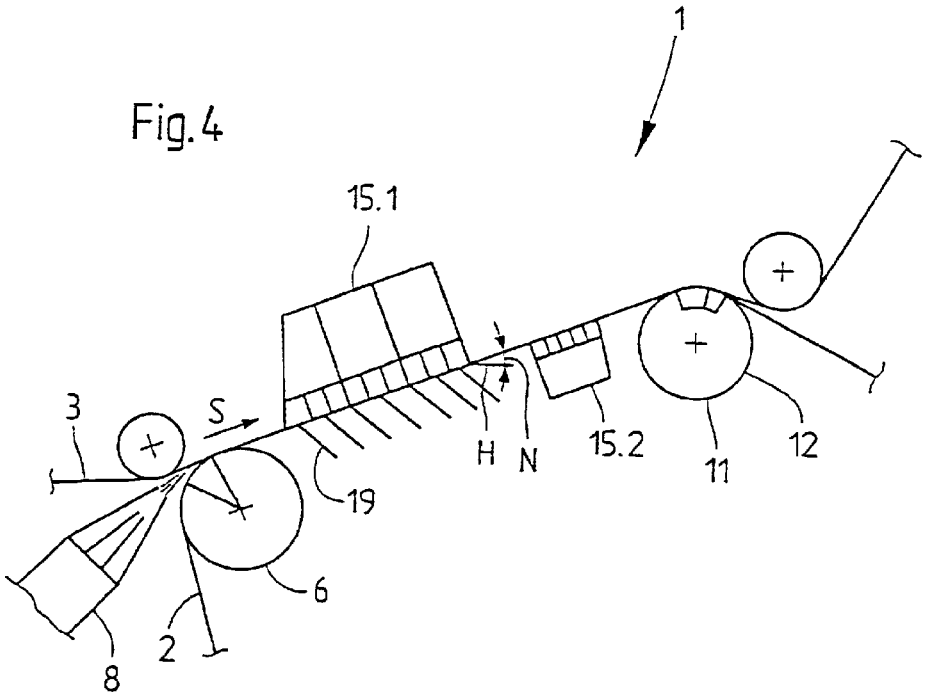
FIG. 4 is a schematic side view of a fourth embodiment of the twin wire former of the present invention.

FIGS. 3 and 4 illustrate schematic side views of a third and fourth embodiment of the twin wire former 1 according to the present invention. Since the configurations are again similar in principal to the embodiment in FIG. 1, we refer you to FIG. 1 for reference.

Both FIG. 3 and FIG. 4 provide, according to the present invention, that the twin wire zone 5, as viewed in the direction of wire travel S, rises from the bottom to the top with an incline N from the horizontal plane H of approximately 5° to 45°. In FIG. 3 the headbox 8 which is illustrated only partially, is located at an angle toward the right bottom and in FIG. 4 at an angle toward the right top. The twin wire formers 1 in both FIG. 3 and FIG. 4 show two forming suction boxes 15.1, 15.2 which are located immediately downstream from the rotating forming roll 6, as viewed in the direction of wire travel S. FIG. 3 illustrates a forming suction box 15.1 located on the bottom wire 2, followed by a forming suction box 15.2 located on the top wire 3, with forming strips 19 located opposite it. In contrast, FIG. 4 shows an arrangement whereby a suction forming box 15.1 is first located on the top wire 3, with forming strips 19 located opposite it, followed by a forming suction box 15.2 located on the bottom wire.

In FIG. 3 a turning roller 21 is located downstream from the second forming suction box 15.2, as viewed in the direction of wire travel S, which allows the twin wire zone 5 to slope from top to bottom in the end zone. A separating element 11 in the embodiment of a transfer suction box 22 which separates the top wire 3 from the formed fiber web 4, and from the bottom wire 2 is located following the turning roller 21. A flat suction box 23 and a suction couch roll 12 are located following the transfer suction box 22. At a downstream pick-up roll 25 the fiber web 4 is taken from the bottom wire 2 by a felt 24 and is transferred to the subsequent manufacturing process.

In FIG. 4 a separating element 11 in the embodiment of a suction couch roll 12 is located downstream from the second forming suction box 15.2 as viewed in the direction of wire travel S. This separates the top wire 3 from the formed fiber web 4 and from the bottom wire 2.

Figure 5:
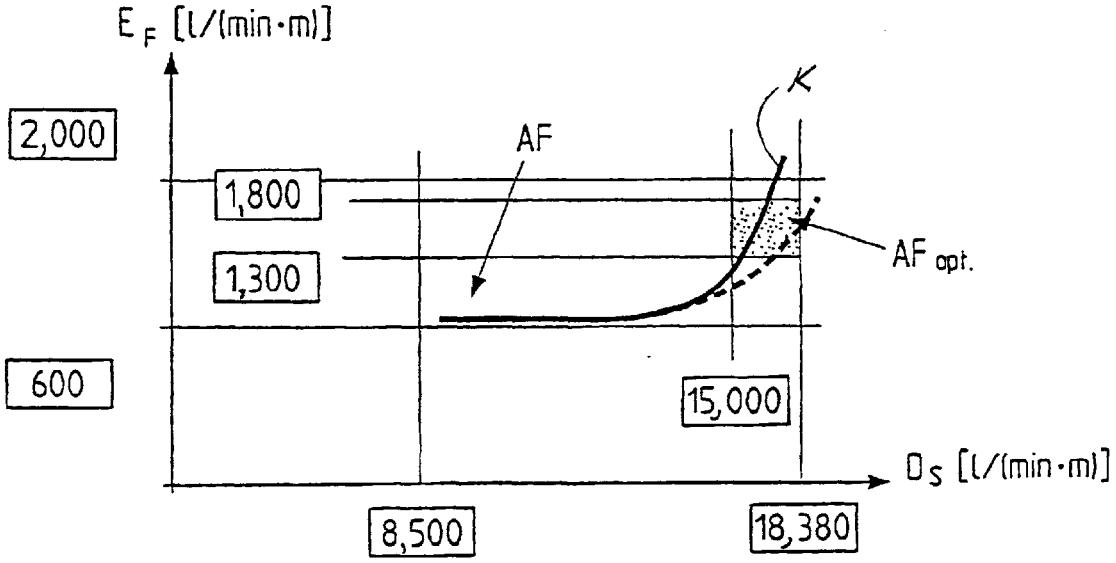
FIG. 5 is a diagram of the operation performance for fiber suspension in a conventional Roll-Blade-Former concept.

FIG. 5 is a diagram of the operating performance for fiber suspensions in a conventional Roll-Blade-Former concept. The abscissa indicates the throughput $D_S$ of fiber suspension through the headbox in [1/(min·m)], the ordinate indicates the forming shoe dewatering $E_F$ in [1/(min·m)]. The throughput $D_S$ assumes a value range of 8,500 [1/(min·m)] (left terminating straight line) to 18,380 [1/(min·m)] (right terminating straight line), while the forming shoe dewatering $E_F$ assumes a value range of 600 [1/(min·m)] (bottom terminating straight line) to 2000 [1/(min·m)] (top terminating straight line). The terminating straight lines provide an operating window in which the Roll-Blade-Former can be operated along a curve K (bold print) with good results within a wider weight range (specific product volume P). Very good results are achieved with the Roll-Blade-Former, for example with a view to sheet formation, within an optimum operating window $Af_{opt.}$ which is defined by the following terminating straight lines: throughput $D_S$ with the terminating straight lines at 15,000 [1/(min·m)] and 18,380 [1/(min·m)], and forming shoe dewatering $E_F$ at 1,300 [1/(min·m)] and 1,800 [1/(min·m)].

Figure 6:
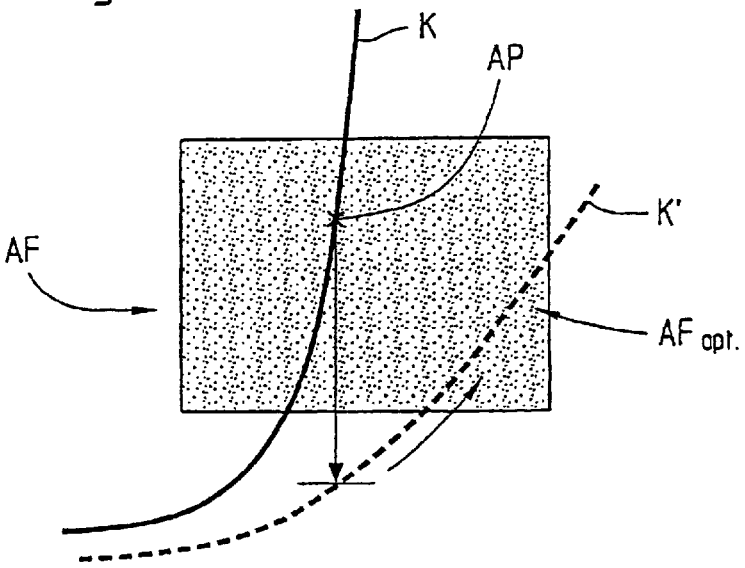
FIG. 6 is an enlarged version of the optimum operating window of the operating performance for fiber suspension in a conventional Roll-Blade-Former concept.

FIG. 6 illustrates an enlarged version of the optimum operating window $Af_{opt.}$, whereby the operating point AP is in the optimum operating window $Af_{opt}$. On product changes the operating point AP leaves the optimum operating window $Af_{opt.}$ (vertical down arrow) and is placed on the curve K' (broken line) outside the operating window $A_F$, providing poorer results. With the known and aforementioned twin wire formers the fiber suspension throughput $D_S$ through the headbox must then be increased in a negative way (upward arrow, angled toward right) in order to return to the optimum operating window.

In summary it can be said that the present invention of a twin wire former provides, that the aforementioned disadvantages of the state of the art are completely avoided and that fiber suspensions containing long fibers which are particularly difficult to form, for example papers, can be put to optimum use.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A twin wire former for the production of a fiber web from a fiber suspension, said twin wire former comprising:

a continuous bottom wire and a continuous top wire, each with a direction of wire travel S, which together define a twin wire zone therebetween;

a headbox including a headbox nozzle;

a rotating forming roll having an open volume, no suction, a forming roll diameter smaller than 1,400 mm and a forming roll angle of wrap smaller than 7°;

a forming suction box located immediately following said rotating forming roll, with respect to said direction of travel S;

a plurality of forming strips located opposite said forming suction box;

an initial area of said twin wire zone in which said bottom wire and said top wire run over said rotating forming roll, said initial area including a wedge-shaped inlet nip defined by the area wherein said bottom wire, said top wire and said rotating forming roll are initially proximate with the fiber suspension, said wedge-shaped inlet nip receiving the fiber suspension from said headbox nozzle at a stock consistency of between 0.4% and 2.0% thereby providing an initial dewatering volume less than 30% on said rotating forming roll;

a central area of said twin wire zone in which the fiber web is formed between said bottom wire and said top wire, said central area including a plurality of dewatering elements and a plurality of forming elements, said plurality of dewatering elements including said forming suction box, and said plurality of forming elements including said forming strips;

an end zone of said twin wire zone in which said bottom wire and said top wire run over a separating element thereby separating one of said bottom wire and said top wire from the fiber web and from the other one of said bottom wire and said top wire.

2. The twin wire former of claim 1, wherein said forming roll has an open surface volume whereby its surface is at least one of grooved, drilled and deflected.

3. The twin wire former of claim 1, wherein said forming roll has an open surface volume whereby it is constructed in a honeycomb design.

4. The twin wire former of claim 1, wherein at least one additional forming suction box is located downstream from said forming suction box as viewed in said direction of wire travel S.

5. The twin wire former of claim 1, wherein said stock consistency is between 0.6% and 1.5%.

6. The twin wire former of claim 4, wherein said forming suction box and said additional forming suction box are located opposite each other and at a distance from each other.

7. The twin wire former of claim 4, wherein at least one of said forming suction box and said additional forming suction box has a curved suction surface having a radius of curvature of between approximately 1,500 mm and 10,000 mm.

8. The twin wire former of claim 7, wherein said additional forming suction box has said curved suction surface having a radius of curvature of between approximately 2,000 mm and 5,000 mm.

9. The twin wire former of claim 4, wherein at least one of said forming suction box and said additional forming suction box includes at least one suction chamber with a vacuum which is at least one of adjustable and controllable with a controllable vacuum source.

10. The twin wire former of claim 4, wherein a plurality of forming strips are located opposite the at least one of said forming suction box and said additional forming suction box.

11. The twin wire former of claim 10, wherein at least one of said forming strips is mounted flexibly.

12. The twin wire former of claim 10, wherein at least one of said forming strips is mounted stationary, whereby its position is adjustable relative to said bottom wire and said top wire.

13. The twin wire former of claim 1, wherein at least one wet suction box is located downstream from at least one said forming suction box as viewed in said direction of wire travel S.

14. The twin wire former of claim 13, wherein said wet suction box is supplied with vacuum, whereby said vacuum is at least one of adjustable and controllable with a controllable vacuum source.

15. The twin wire former of claim 1, wherein a turning roller is located prior to said separating element as viewed in said direction of wire travel S.

16. The twin wire former of claim 15, further including at least one flat suction box and a suction couch roll located following said separating element as viewed m said direction of wire travel.

17. The twin wire former of claim 1, wherein said headbox includes at least one machine-wide separating element located in said headbox nozzle.

18. The twin wire former of claim 1, wherein said twin wire zone rises essentially vertically from the bottom to the top as viewed in said direction of wire travel S.

19. The twin wire former of claim 16, wherein said twin wire zone rises with a vertical excursion from the vertical plane of −15° to +15°.

20. The twin wire former of claim 19, wherein said twin wire zone rises with said vertical excursion from the vertical plane of −5° to +5°.

21. The twin wire former of claim 1, wherein said twin wire zone rises from the bottom to the top with an incline from the horizontal plane of approximately 5° to 45° with respect to said direction of wire travel S.

22. The twin wire former of claim 21, wherein said twin wire zone slopes in the end zone from the top to the bottom.

23. The twin wire former of claim 1, wherein said separating element is a suction couch roll.

24. The twin wire former of claim 1, wherein said separating element is a transfer suction element.

* * * * *

UNITED STATES PATENT AND TRADEMARK OFFICE

CERTIFICATE OF CORRECTION

PATENT NO. : 6,776,877 B2
DATED : August 17, 2004
INVENTOR(S) : Grabsoheid et al.

It is certified that error appears in the above-identified patent and that said Letters Patent is hereby corrected as shown below:

Title page,
Item [57], ABSTRACT,
Line 10, please delete "70º" and insert therefore -- 7º --.

Column 2,
Line 35, please delete "70" and substitute therefore -- 7º --.

Column 4,
Line 41, please delete "DF" and substitute therefore -- $D_F$ --; and
Line 42, please delete "wrap a" and substitute therefore -- wrap $\alpha$ --.

Column 5,
Line 19, please delete "Av" and substitute therefore -- $A_v$ --.

Column 8,
Line 30, please delete "viewed m" and substitute therefore -- viewed in --.

Signed and Sealed this

Fifth Day of April, 2005

JON W. DUDAS
*Director of the United States Patent and Trademark Office*